US011053033B1

(12) United States Patent
Hunter

(10) Patent No.: US 11,053,033 B1
(45) Date of Patent: Jul. 6, 2021

(54) METHOD OF CONSTRUCTING A PACKAGING AND DISPLAYING ASSEMBLY

(71) Applicant: Aleathia G. Hunter, Milford, PA (US)

(72) Inventor: Aleathia G. Hunter, Milford, PA (US)

( * ) Notice: Subject to any disclaimer, the term of this patent is extended or adjusted under 35 U.S.C. 154(b) by 493 days.

(21) Appl. No.: 15/732,630

(22) Filed: Dec. 6, 2017

Related U.S. Application Data

(60) Provisional application No. 62/497,873, filed on Dec. 7, 2016.

(51) Int. Cl.
*B65B 11/00* (2006.01)
*B65B 67/00* (2006.01)
*B65B 61/16* (2006.01)

(52) U.S. Cl.
CPC ..... *B65B 11/004* (2013.01); *B65B 61/16* (2013.01); *B65B 67/00* (2013.01)

(58) Field of Classification Search
CPC ..... B65B 11/004; B65B 11/48; B65B 61/16; B65B 61/14; B65B 15/00; B65B 15/02; A45C 11/00; B65D 5/4608; B65D 5/46032; B65D 73/0078; B31D 1/005
USPC ..... 53/134.1
See application file for complete search history.

(56) References Cited

U.S. PATENT DOCUMENTS 2,434,630 A * 1/1948 Van Rosen ..... B65D 5/46032 16/406
2,718,301 A * 9/1955 Palmer ..... B65D 71/36 206/427
2,828,063 A * 3/1958 Struble ..... B65D 5/46032 229/117.24
3,383,827 A * 5/1968 Schaich ..... B65B 17/025 53/398
3,732,661 A * 5/1973 Goldberger ..... B29C 65/7433 53/134.1
4,566,252 A * 1/1986 Watanabe ..... B65B 61/16 383/37
6,574,942 B1 * 6/2003 Heimann ..... B65B 61/16 493/226
8,091,705 B1 * 1/2012 McCutchen ..... B25H 3/021 206/486
8,579,779 B2 * 11/2013 Totani ..... B65D 31/08 493/189
8,739,503 B2 * 6/2014 Smith ..... B65D 71/48 53/443

(Continued)

OTHER PUBLICATIONS http://packasmile.com/home—Alithea Hunter (Year: 2013).*

*Primary Examiner* — Anna K Kinsaul
*Assistant Examiner* — Daniel Jeremy Leeds
(74) *Attorney, Agent, or Firm* — Sandra M. Kotin

(57) ABSTRACT

A method for constructing a packaging and displaying assembly utilizes a hand held punch or other punching device equipped with a specially designed template and a strip of card stock that is dimensioned to hold and display the item for sale. The template produces two cutouts in the top of the strip which is thereafter folded down to form a flap leaving upright a rounded tab with a centered opening. The item for sale may be affixed directly to the card stock under the flap or placed within a transparent envelope that is similarly affixed to the card stock. The resulting package with the item clearly visible is placed onto a display bar by threading the bar through the centered opening. The card stock may contain informative or decorative indicia to make the packages appealing for sale.

7 Claims, 3 Drawing Sheets

(56) References Cited

U.S. PATENT DOCUMENTS 8,763,503 B1* 7/2014 Hunter ..... B26F 1/32 83/167
2005/0284107 A1* 12/2005 Concetti ..... B65B 61/16 53/413
2006/0151348 A1* 7/2006 Willard ..... B65D 73/0078 206/449
2007/0045131 A1* 3/2007 Kim ..... B65D 25/22 206/6.1
2007/0251982 A1* 11/2007 Brand ..... B65D 5/241 229/101
2008/0023352 A1* 1/2008 Creed ..... B65D 73/0078 206/232
2009/0091123 A1* 4/2009 Conley ..... B65D 73/0078 283/106
2009/0266872 A1* 10/2009 Fogle ..... B65B 11/004 229/100
2009/0277808 A1* 11/2009 Payne ..... B42D 15/045 206/232
2010/0089987 A1* 4/2010 Brandinelli ..... B65D 5/46032 229/117.22
2012/0153109 A1* 6/2012 Milbrandt ..... B65D 23/005 248/224.8
2014/0041160 A1* 2/2014 Bowman ..... B31D 1/0056 24/16 R
2014/0053507 A1* 2/2014 Oblisk ..... B65D 61/00 53/413
2015/0344205 A1* 12/2015 Lebras ..... B65D 21/0206 206/510
2016/0280436 A1* 9/2016 Taylor ..... B65D 71/50
2017/0231344 A1* 8/2017 Zumbiel ..... A45C 11/00 53/411
2017/0253367 A1* 9/2017 Mundt ..... B65D 5/46032
2017/0297795 A1* 10/2017 Zacherle ..... B65D 71/0022

* cited by examiner

METHOD OF CONSTRUCTING A PACKAGING AND DISPLAYING ASSEMBLY

This application contains the same material disclosed in a Provisional Patent application Ser. No. 62/497,873 filed on Dec. 7, 2016. The information regarding the Provisional Patent is contained in the Application Data Sheet submitted herewith.

FIELD OF THE INVENTION

The instant invention relates to a method to construct an assembly for use in the packaging and displaying of small articles to sell or exhibit.

BACKGROUND OF THE INVENTION

Many types of merchandise offered for sale or exhibition are displayed in packets hung on extended bars or hooks so that selected quantities of packets can be exhibited in a relatively small space. These packets often consist of a piece of stiff paper or card stock folded over at the top to which is attached the article for sale or a transparent envelope containing the article for sale fastened between the two parts of the folded paper as seen in FIG. 1. The stiff paper usually has a single hole, round, or otherwise shaped, and centered near the top of the folded part of the paper, through which the packets are threaded onto the hanging or display bar. Other such display packets may have a plastic tab containing the hole affixed to the back of the folded piece of paper (not illustrated). The tabs are then threaded onto the display bar. These display packets are utilitarian but not aesthetically pleasing. Many packets may be produced in a single operation by packaging machines and sent directly to retailers for mass marketing.

The craftsman who takes pains to hand make articles for sale often wants a more pleasing display means and one that he can make as needed in his place of business. He may want to vary the display means according to the size, shape and specific character of the article.

There is a need for a means to construct a packaging assembly that can be hung on a hook or display bar and that can be made as needed by a craftsman. There is a need for a simple method that can produce the packaging from card stock with indicia on it that may advertise the craftsman and/or otherwise contain decorative indicia to enhance the product being displayed.

BRIEF SUMMARY OF THE INVENTION

The present invention provides a method to produce an assembly for packaging and displaying a variety of articles which utilizes a specially designed template to be incorporated into a hand held punch or other punching device to enable a craftsman to construct the display assemblies in which to showcase his products as needed.

It is an object of the present invention to provide a simple method to construct an assembly to contain and display an article for sale or exhibit.

It is a further object of the present invention to provide a specially designed template for a hand held punch or other punching device for use in constructing the packaging and displaying assembly.

Another object of the present invention is to provide a method that utilizes a business card or embellished card stock in the construction of the packaging and displaying assembly.

A further object of the present invention is to provide a method to construct the assembly that is versatile and usable for products of varied sizes, shapes and weights.

A still further object of the present invention is to provide a method of constructing a packaging and displaying assembly that can have the product to be displayed plainly seen on or through the packaging material.

It is another object of the present invention to provide a method for constructing a packaging and displaying assembly that is inexpensive and easy to produce whenever needed.

The invention is method for constructing an assembly for packaging and displaying an item for sale or exhibit comprising the steps of obtaining a strip of card stock having an upper portion, the upper portion exhibiting a first cutout substantially in the shape of an arc of a circle and a second cutout centered horizontally within the arc and shaped to accept a display bar. The first cutout is in the shape of an arc of a circle and has a center of the arc and two ends of the arc and the arc is narrow at the center and widens toward the two ends, and the two ends of the arc are angled inward such that they are not horizontal and not parallel to each other, then folding the upper portion of the strip forward and downward exposing a rounded tab with the second cutout horizontally centered in the tab, and the folded upper portion becoming a front flap covering a portion of the strip, the covered portion and remaining portion of the strip forming a support base extending downward behind and below the flap. Thereafter affixing the item to the assembly to form a package such that the item is not damaged or altered and hanging the package on the display bar by threading the display bar through the second cutout in the tab, whereby one or more packages can be hung on the same display bar and the item can be exhibited.

The invention is also a method for constructing an assembly for packaging and displaying au item for sale or exhibit comprising the steps of obtaining a strip of card stock having an upper portion exhibiting two voids. a first void substantially in the shape of an arc of a circle, the arc having a center and two ends whereby the arc is narrow at the center widening toward the two ends, the two ends being angled inward such that they are not horizontal and not parallel to each other, and a second void centered horizontally within the arc and shaped to accept a display bar; folding the upper portion of the strip forward and downward thereby exposing a rounded tab in the shape of an arc of a circle formed by the first void with the second void being horizontally centered in the tab, and the folded upper portion forming a front flap covering a portion of the strip, the covered portion and remaining uncovered portion of the strip forming a support base extending downward behind and below the flap to a lower end of the strip. Thereafter affixing the item to be displayed to the strip such that the item is supported on the support base and the item cannot easily be dislodged, damaged or altered thereby creating a package; and hanging the package on the display bar by threading the display bar through the second void centered within the tab.

Other features and advantages of the invention will be seen from the following description and drawings.

DETAILED DESCRIPTION OF THE INVENTION

The method of constructing the packaging and displaying assembly of the instant invention may be dependent upon the use of a hand held punch fitted with a specially designed template. A set of corresponding suitably configured cutting elements may cooperate with the template to produce the desired cut out pattern in a piece of card stock which may form the supporting structure for the assembly. Such hand held punches are described in U.S. Pat. No. 8,763,503 and U.S. Pat. No. RE46627 both to Hunter. Other punching devices utilizing this template and cooperating cutting elements may also be used for the method of the instant invention.

The template itself may consist of two plates with identical cutout patterns fixedly mounted one above the other such that the identical openings in both plates are perfectly aligned. The two plates may be spaced apart just enough to admit the piece of card stock between them. This mounting may also permit the cutting elements to pass smoothly through the upper plate, the card stock and the lower plate to effect clean cutouts in the card stock. The unique cutout pattern may provide the hanging means for the assembly.

Figure 2:
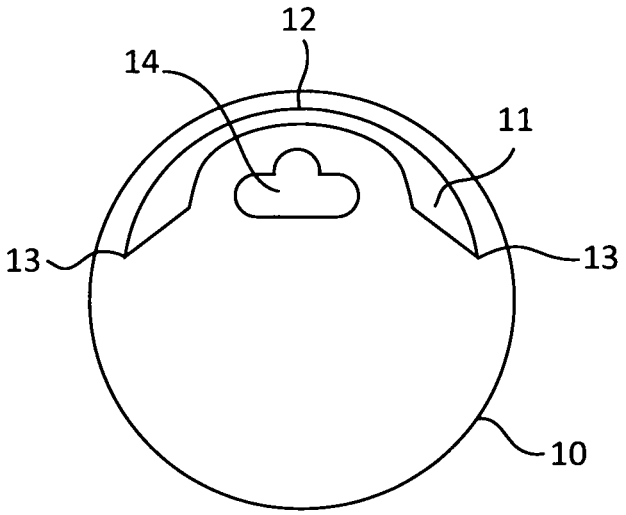
FIG. 2 is top plan view of the template pattern for the punching device required for the method of the instant invention.
Figure 3:
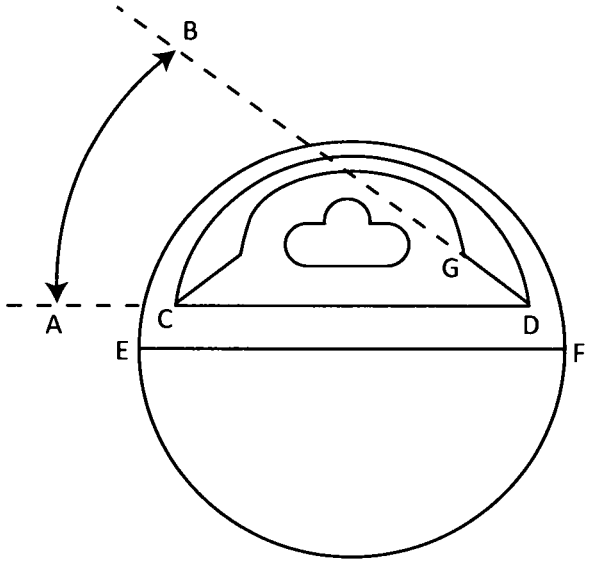
FIG. 3 is a top plan view of the template pattern of FIG. 2 showing the angle of the ends of the first cut out.
Figure 7:
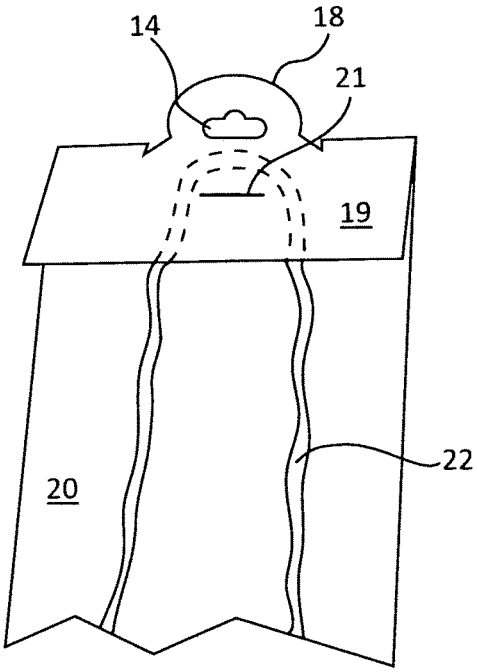
FIG. 7 is a front perspective view of an assembly displaying a necklace.
Figure 8:
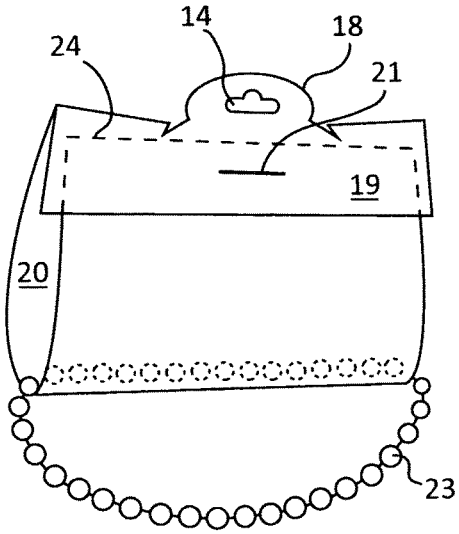
FIG. 8 is a front perspective view of an assembly displaying a bracelet.
Figure 9:
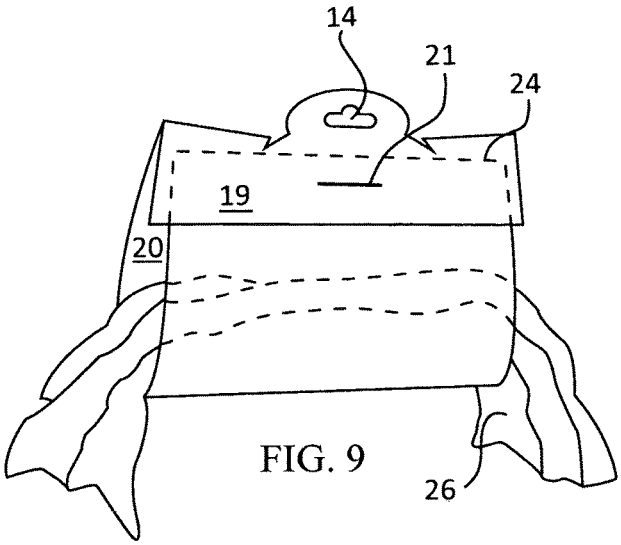
FIG. 9 is a front perspective view of an assembly displaying a scarf.
Figure 10:
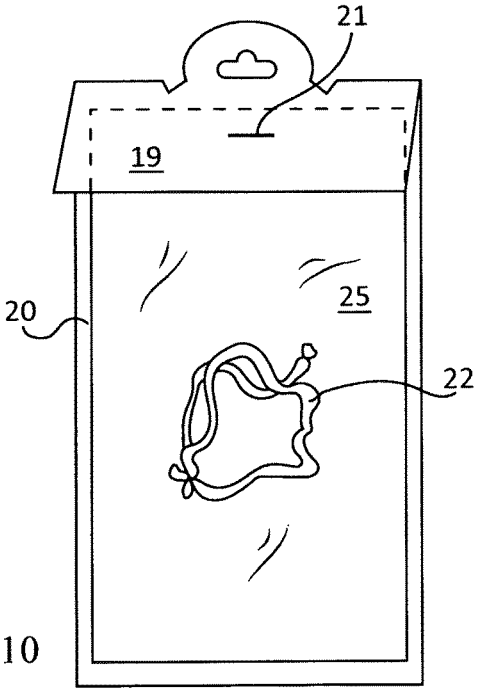
FIG. 10 is a front perspective view of an assembly displaying a necklace within a transparent envelope.

The template pattern or plate 10 seen in FIGS. 2 and 3 may consist of a pattern of two cutouts. The first cutout 11 may be an arc of a circle in the form of a substantially semicircular opening that may widen slightly from its midpoint 12 (the top of the arc) to its end points 13. The ends DG of the first cutout 11 may be angled inward such that they are not horizontal and are not parallel. A line from one end point to the other, line CD, if extended may represent a chord of the circle. The chord may be parallel to and lie above the diameter EF. The two ends DG of the cutout may be at an angle of substantially 60° (angle AB) measured from the line CD.

The second cutout 14 may be substantially centered beneath the arc of the first cutout 11 and may be a simple circular opening, or may be an opening that has a horizontal portion and a semicircular top portion (as seen in FIGS. 2-10), often referred to as the 'sombrero opening' or the 'hanger hole'. This configuration may prevent the packages from sliding horizontally when placed on the display bar.

As noted above, the supporting structure of the assembly is made from a piece of card stock, typically of 80 lb bond, but other somewhat heavier card stock may be used. A true cardboard may not fit between the plates of the template, could damage the cutting elements of the punching device, and would not have the necessary flexibility. A heavy paper may not have the necessary strength to support the packets on the display bar, but may be sufficient for displaying very light materials such as a packet of sequins or cotton balls. The template may be constructed in various sizes to accommodate different products but the size described below may be suitable for most types of merchandise that may be displayed in the manner described herein.

A typical size of the piece of card stock that may be used to display a variety of items may have as minimum dimensions, a width of 2 in. (5.1 cm) and a length of 3.5 in. (8.9 cm), the size of a typical business card. The length and width may be longer as needed according to the item to be displayed. A craftsman's business card may be used as the supporting structure for the display assembly and will have his business information on it. A piece of card stock may be produced with specific indicia or a design to enhance the craftsman's product line. Instructions for the use of the item displayed or descriptive information may also be placed on the card stock. A more versatile strip may be 2 in. (5.1 cm) in width but the length may be determined by the specific packaging needs. When a business card is used, or a longer piece of card stock is to be cut using a hand held punch, the short length 16 of the card, 2 in. (5.1 cm) wide, may be inserted into the punch.

The supporting structure of the packaging assembly may be referred to as the strip 15 of card stock. The two plates of the template for the hand held punch may be constructed and mounted to accept the upper 2.25 in (5.7 cm) portion of the strip as it may be inserted into the punch. The strip 15 may be centered in the punch so that the resulting cutouts may be centered in the upper portion of the strip. When the strip is punched, the first cut out 11, the arc, may be inverted and the second cut out 14 may be centered within and above the arc as may be seen in FIG. 4. This may result in having the center of the arc of the substantially semicircular first cutout 11 being substantially 1.68 in (4.3 cm) from the upper edge of the strip and the center of second cutout 14 being substantially 1.125 in (2.9 cm) from the upper edge of the strip.

Figure 1:
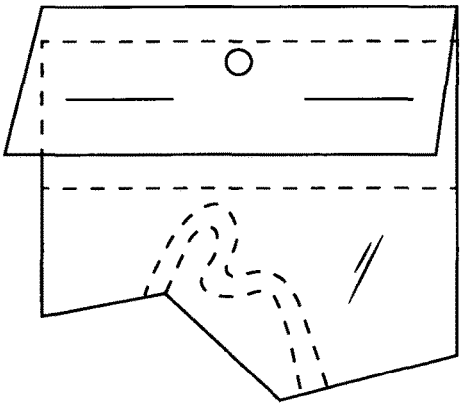
FIG. 1 [Prior Art]
FIG. 1 is a front perspective view of a typical prior art package assembly.
Figure 4:
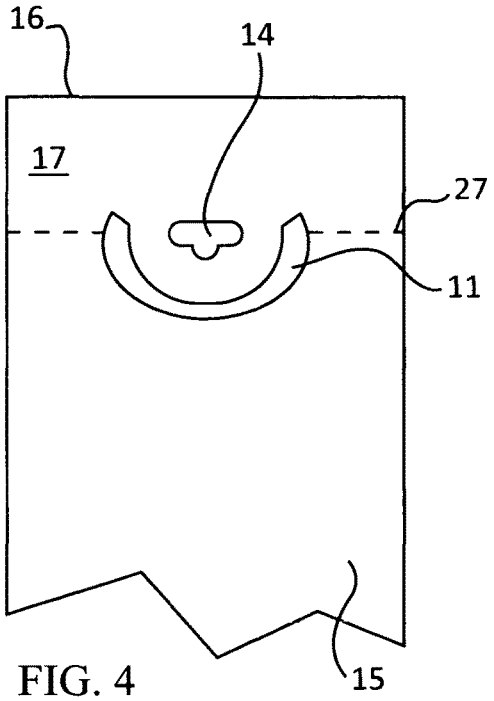
FIG. 4 is a top plan view of a cut piece of card stock according to the method.
Figure 5:
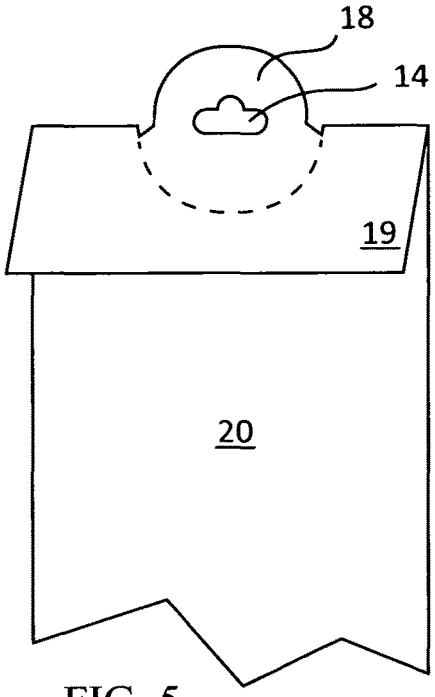
FIG. 5 is a front perspective view of a piece of cut and folded card stock.
Figure 6:
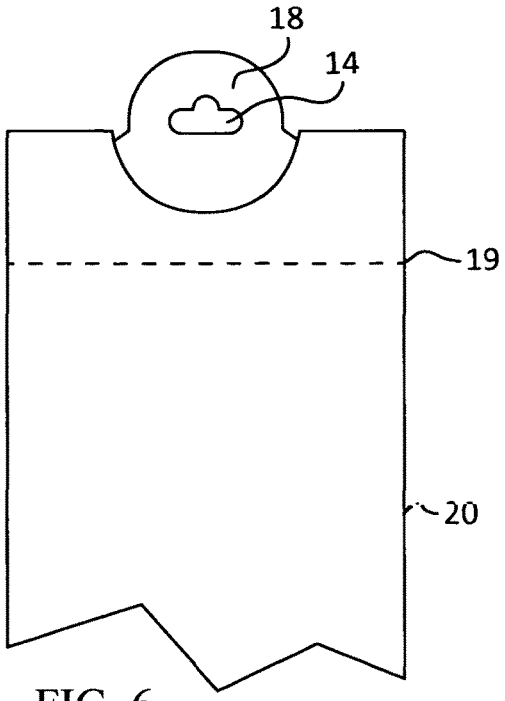
FIG. 6 is a real plan view of the cut and folded card stock of FIG. 5.

Once the strip has been punched, the upper portion 17 of the strip may be folded forward along an imaginary line 27 shown in FIG. 4 such that the folded piece lies over the remainder of the strip 15. Once the upper portion 17 is folded down, a rounded tab 18 formed by the first cutout 11 remains upright with the second cutout 14 horizontally centered in the tab 18. The folded portion may become a flap 19, which may extend downward over the front of the strip 15. The remainder of the strip 15 extending from the fold line 27 to the lower end 24 of the strip 15 may form the support base 20 of the assembly. A variety of items may be displayed using this assembly such as jewelry, beads, small craft materials and tools, sequins or cotton balls, to name just a few. FIG. 5 may be a front view and FIG. 6 may be a rear view of the completed display structure before a product has been affixed to it.

If the item to be displayed is to be fastened directly to the support base 20, the strip may be sized in length to accommodate the item. Some types of items may be fastened directly to the support base 20 using a staple 21 or other type of fastener. If a necklace or chain is to be displayed it may be affixed directly to the strip, or in an alternative manner, the circular necklace 22 (clasp fastened) may be placed against the top of the support base 20 under the flap 19, the flap folded down over the necklace, and a fastener such as a staple 21 placed through the flap 19 and the support base 20 below a portion of the necklace as may be seen in FIG. 7. Using this method of attachment, the fastening means does not touch the necklace itself, but affixes it securely to the assembly. Additional staples may be added as needed to maintain the flap 19 in the folded orientation. A bracelet 23 may also be attached in this manner or, it may be attached by placing the circular bracelet 23 (clasp fastened) against the midpoint of the support base 20 and folding the lower end 24 of the support base 20 upward through the bracelet and up under the flap 19 so that the lower end 24 of the support base 20 may be affixed under the flap 19 by one or more fastener such as a staple 21. The bracelet 23 may then be held in place by the folded support base 20 as may be seen in FIG. 8.

The item to be displayed may also be placed into a transparent envelope 25 for a more secure display. This may be advantageous for jewelry and may also be the best way to package and display beads, clips or other multiple small items.

Many types of transparent envelopes 25 are commercially available, from celluloid to plastic bags to interlocking closure bags. When a transparent envelope 25 is used the item or items may be placed into the envelope 25 and the top of the envelope may be placed against the support base 20 under the flap 19 and the flap secured with fasteners providing a hold on the envelope, securing the fold in place, and enabling the contents of the envelope to be easily seen. Additional fasteners maybe used as needed. In the alternative, the end of the envelope may be folded over and the folded portion placed under the flap 19 and secured in place. An interlock closed plastic bag or zip-lock bag may be filled and the sealed top portion placed under the flap 19 and secured in place. An example of the use of a transparent envelope 25 assembly may be seen in FIG. 10. As illustrated, the envelope is narrower than the support base. The transparent envelope may also be wider than the support base and/or longer than the support base (not illustrated) and still maintain the item or items securely and permit them to be clearly seen.

This same display method may by used for small clothing items. A scarf 26 may easily be secured by bringing the end 24 of the support base 20 around the scarf 26, full length or folded over, and securing it under the flap 19 in the same manner as the bracelet 23 (illustrated in FIG. 8). The assembly with a scarf 26 may be seen in FIG. 9.

Much larger items may also be displayed with this method using the hand held punch or other punching device and an appropriate piece of card stock. The weight of the item may be more determinative than the size since the cutout rounded tabs 18 may be the actual means of supporting the item on the display bar. An article that is too heavy may tear the tab so the package cannot remain on the bar. Larger items requiring wider strips may utilize the same size template, though a larger template may be constructed for larger and/or heavier items as needed. When the larger template is used, the space between the plates may be made slightly wider to enable heavier card stock to be cut. This may provide a stronger hanging tab to support heavier items.

While one embodiment of the present invention has been illustrated and described in detail, it is to be understood that this invention is not limited thereto and may be otherwise practiced within the scope of the following claims.

I claim:

1. A method for constructing an assembly for packaging and displaying an item for sale or exhibit, said method comprising the steps of:

obtaining a strip of card stock having an upper portion, said upper portion exhibiting a first cutout substantially in the shape of an arc of a circle and a second cutout centered horizontally within the arc and shaped to accept a display bar, wherein the first cutout in the shape of an arc of a circle has a center of the arc and two ends the arc and the arc is narrow at the center and widens toward the two ends, and the two ends of the arc are angled inward such that they are not horizontal and not parallel to each other;

folding the upper portion of the strip forward and downward exposing a rounded tab with the second cutout horizontally centered in the tab, and the folded upper portion becoming a front flap covering a portion of the strip, the covered portion and remaining portion of strip forming a support base extending downward behind and below the flap;

affixing the item to the assembly to form a package such that the item is not damaged or altered; and hanging the package on the display bar by threading the display bar through the second cutout in the tab;

whereby one or more packages can be hung on the same display bar and the item can be exhibited.

2. A method as described in claim 1 wherein the two ends of the arc form an angle of substantially 60° with an imaginary straight line drawn from one end to the other.

3. A method for constructing an assembly for packaging and displaying an item for sale or exhibit, said method comprising:

obtaining a strip of card stock;

having an upper portion exhibiting two voids a first void substantially in the shape of an arc of a circle, said arc having a center and two ends whereby the arc is narrow at the center widening toward the two ends, said two ends being angled inward such that they are not horizontal and not parallel to each other, and a second void centered horizontally within the arc and shaped to accept a display bar;

folding the upper portion of the strip forward and downward thereby exposing a rounded tab in the shape of an arc of a circle formed by the first void with the second void being horizontally centered in said tab, and the folded upper portion forming a front flap covering a portion of the strip, said covered portion and remaining uncovered portion of the strip forming a support base extending downward behind and below the flap to a lower end of the strip;

affixing the item to be displayed to the strip such that said item is supported on the support base and the item cannot easily be dislodged, damaged or altered thereby creating a package; and hanging the package on the display bar by threading the display bar through the second void centered within the tab.

4. A method as described in claim 3 further comprising the steps of:

placing the item across the support base at substantially a midpoint of said support base;

bringing the lower end of the strip forward and upward to curve around the item such that the item is substantially contained within the curvature of the support base;

inserting the lower end of the strip under the flap; and securing the lower end of the strip under the flap with at least one fastener that passes through the flap, through the lower end of the strip and through the covered portion of the support base thereby creating a package consisting substantially of the item and the strip.

5. A method as described in claim 3 wherein the two ends of the arc form an angle of substantially 60° with an imaginary straight line drawn from one end to the other end of the arc.

6. A method as described in claim 3 further comprising the steps of:

placing a portion of the item under the flap with the remainder of the item extending below the flap and lying against the support base; and securing the item under the flap with at least one fastener that passes through the flap and below the portion of the item disposed under the flap, and through the covered portion of the support base such that the item is held in place by the at least one fastener so that it cannot be dislodged, thereby creating a package that includes the strip and the item.

7. A method for constructing an assembly for packaging an item for sale or exhibit as described in claim 3 further comprising the steps of:

obtaining a transparent elongated container dimensioned such that the length of the container is substantially the length of the support base and the width of the container is substantially the width of the support base, said container having an open top end and further being of sufficient size to contain the item;

placing the item into the container;

placing the top end of the container against the covered part of the support base under the flap; and securing the top end of the container under the flap with at least one fastener such that the at least one fastener passes through the flap, through the top end of the container and through the covered part of the support base creating a package thereby enabling the item to be clearly seen and said container with the item therein is supported along the length of the support base and cannot easily be dislodged, damaged or altered.

* * * * *